US005924806A

United States Patent [19]

Ainsworth

[11] Patent Number: 5,924,806

[45] Date of Patent: Jul. 20, 1999

[54] POS STATION OUTPUT SIGNAL CONVERSION METHOD AND SYSTEM

[75] Inventor: Elwyn Thomas Ainsworth, Delray Beach, Fla.

[73] Assignee: Sensormatic Electronics Corporation, Boca Raton, Fla.

[21] Appl. No.: 09/016,621

[22] Filed: Jan. 30, 1998

[51] Int. Cl.[6] ..... B41J 2/315

[52] U.S. Cl. ..... 400/120.01; 400/76; 400/83; 400/61; 400/63

[58] Field of Search ..... 400/76, 83, 61, 400/63, 120.01; 364/405

[56] References Cited

U.S. PATENT DOCUMENTS

| | | | |
|---|---|---|---|
| 4,410,965 | 10/1983 | Moore | 365/230 |
| 4,833,609 | 5/1989 | Grulke, Jr. | 364/405 |
| 4,841,422 | 6/1989 | Hosoyama | 364/405 |

*Primary Examiner*—Edgar Burr
*Assistant Examiner*—Charles H. Nolan, Jr.
*Attorney, Agent, or Firm*—Robin, Blecker & Daley

[57] ABSTRACT

A method for processing single line data and multiple line data generated at a POS station for driving a printer thereof into common structure data, e.g., single line data, the method comprising the steps of defining a first lookup table having first signal content corresponding to literal article identifications of articles and article price encompassed in the single line data and having second signal content corresponding to literal identifications of articles encompassed in the multiple line data and flag data, defining a second lookup table having signal content corresponding to article identifications of articles encompassed in the multiple line data cross-correlated with additional multiple line data, furnishing the single line data and multiple line data generated at the POS station for driving the printer thereof to the first lookup table and determining correspondence of literal identifications in the single line data and the multiple line data with literal identifications stored in the first lookup table and detecting flag data therein. Upon determinations of correspondence of literal identifications without accompanying detection of flag data, the contents of the first lookup table are furnished as single line output data. Upon determinations of correspondence of literal identifications with accompanying detection of flag data, the contents of the second lookup table are furnished as single line output data. A system for implementing the method includes circuit means for performing the foregoing steps of the method.

3 Claims, 3 Drawing Sheets

POS STATION OUTPUT SIGNAL CONVERSION METHOD AND SYSTEM

FIELD OF THE INVENTION

This invention relates generally to so-called "POS" (Point of Sale) systems, such as are found in retail facilities, and pertains more particularly to systems and methods for use in adapting POS systems to host computer equipment.

BACKGROUND OF THE INVENTION

It is customary in current day retailing practices, to have checkout counters at the exit of a facility, each equipped with a clerk-controlled POS station effecting checkout of articles through bar code scanning, retrieval of article price from a storage unit containing article price cross-correlated with article bar code, display of the description and price of each article selected for checkout to a customer, and selected article price totalization, and providing the customer with a printout of the customer's transactions in purchasing articles.

A data structure disparity exists as between signals generated by a POS station for use in providing the printout of customer's transactions and signals processable by host computer equipment. For instance, bar code lookup for bottled or canned goods, e.g., baked beans or tomato soup, yields single line data, decodable as so-called "SLD" (single line decoding). The respective single line data would read "BAKED BEANS 0.35" and "TOM SOUP 0.30". This type of data is readily processable by host computer equipment.

However, for other goods, typically unpackaged produce, bar code lookup yields multiple line data, decodable as so-called "MLD". For example, the data furnished at the POS to its printer in this instance may comprise a first line "LOOSE CARROTS" and a second line "1.0 Kg @ 0.25/Kg 0.25". Since the POS and printer software for decoding is, readily managed independently of the host computer equipment, no difficulty attends the data structure disparity as between SLD and MLD at the POS station level.

The data structure disparity, however, takes on significance in transmissions from POS stations to host computer equipment. The latter is manufactured without facility for input tolerance of data having decoding meaning only under MLD constraints and, evidently, the manufacturer's of POS equipment have no interest in or desire to adversely make inroads on their products to accommodate data structure disparities as between their equipment and host computer equipment. Thus, POS equipment is presently operated at or close to its performance limits and any additional processing requirements are perceived by the manufacturers and their client to hinder the essential function of POS equipment.

SUMMARY OF THE INVENTION

The present invention has as its primary object the provision of systems and methods for overcoming the foregoing data structure disparity problem as between POS stations and host computer equipment.

In attaining the primary object, the invention provides a method for processing single line data and multiple line data generated at a POS station for driving a printer thereof into common structure data, e.g., single line data, the method comprising the steps of defining a first lookup table having first signal content corresponding to literal article identifications of articles and article price encompassed in the single line data and having second signal content corresponding to literal identifications of articles encompassed in the multiple line data and flag data, defining a second lookup table having signal content corresponding to article identifications of articles encompassed in the multiple line data cross-correlated with additional multiple line data, furnishing the single line data and multiple line data generated at the POS station for drilling the printer thereof to the first lookup table and determining correspondence of literal identifications in the single line data and the multiple line data with literal identifications stored in the first lookup table and detecting flag data therein. Upon determinations of correspondence of literal identifications without accompanying detection of flag data, the contents of the first lookup table are furnished as single line output data. Upon determinations of correspondence of literal identifications with accompanying detection of flag data, the contents of the second lookup table are furnished as single line output data.

Systems implementing the foregoing methods are set forth hereinafter.

The foregoing and other objects and features of the invention will be further understood from the following detailed description thereof and from the drawings, wherein like components are identified by common reference numerals throughout.

DETAILED DESCRIPTION OF PREFERRED PRACTICES AND EMBODIMENTS

Figure 1:
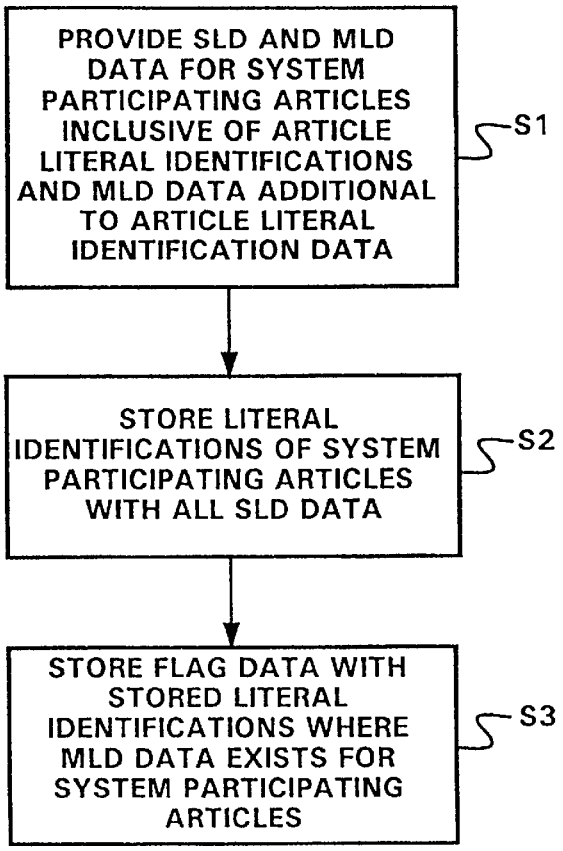
FIG. 1 is a flowchart indicating steps of loading a first lookup table in accordance with the invention.

Referring to FIG. 1, the practice for loading a first lookup table involves outset step S1, PROVIDE SLD AND MLD DATA FOR SYSTEM PARTICIPATING ARTICLES INCLUSIVE OF ARTICLE LITERAL IDENTIFICATIONS AND MLD DATA ADDITIONAL TO ARTICLE LITERAL IDENTIFICATION DATA. In this step, one collects all signal data for single line and multiple line from the POS printer drive signals, e.g., signals indicative of the foregoing exemplary "BAKED BEANS 0.35", "TOM SOUP 0.30" and "LOOSE CARROTS" and its second line "1.0 Kg @ 0.25/Kg 0.25".

In step S2, STORE LITERAL IDENTIFICATIONS OF SYSTEM PARTICIPATING ARTICLES WITH ALL SLD DATA, all literal identifications collected in step S1 (SLD and MLD) are stored as is all single line data associated therewith, i.e., the price information for the SLD packaged, bottled, etc., goods. The MLD data additional to the article identification data is not stored.

In step S3, STORE FLAG DATA WITH STORED LITERAL IDENTIFICATIONS WHERE MLD DATA EXISTS FOR SYSTEM PARTICIPATING ARTICLES, the lookup table is completed by associating a flag with MLD data entries stored in step S2. The flag data is of a nature which causes progress to the second lookup table, now discussed in connection with FIG. 3.

In step S4, STORE LITERAL IDENTIFICATIONS OF SYSTEM PARTICIPATING ARTICLES HAVING MLD DATA ADDITIONAL TO ARTICLE LITERAL IDENTIFICATION DATA, article literal identifications for only the articles having multiple line structure are stored.

In step S5, STORE MLD ADDITIONAL DATA WITH STORED LITERAL IDENTIFICATIONS, the second lookup table is completed by storing the multiple line additional data with the previously stored article literal identifications in step S4.

Figure 2:
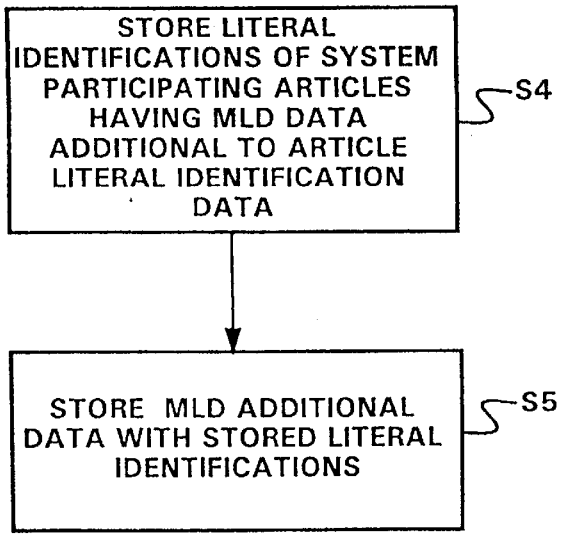
FIG. 2 is a flowchart indicating steps of loading a second lookup table in accordance with the invention.
Figure 3:
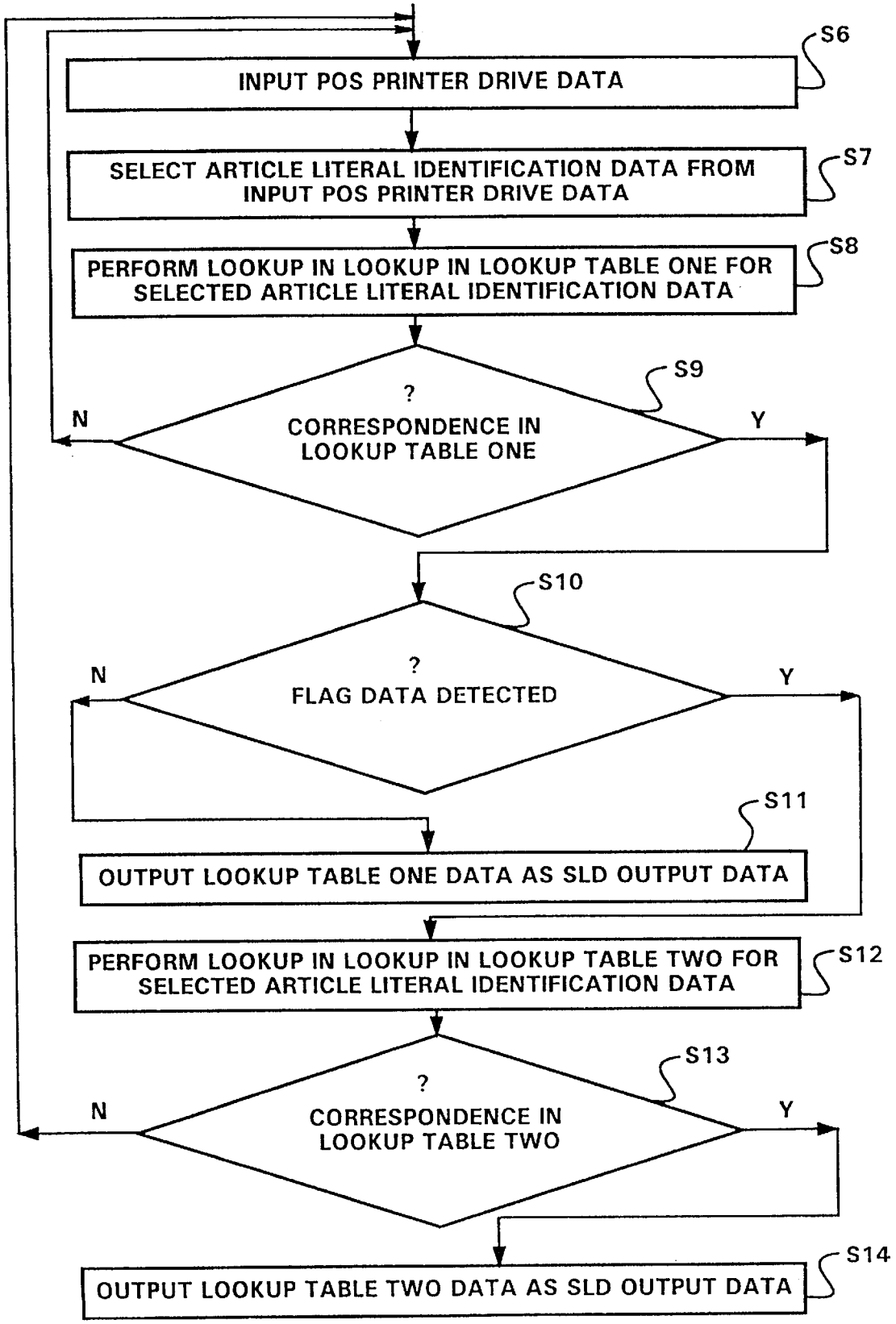
FIG. 3 is a flowchart of steps of a signal conversion practice in accordance with the invention.

Turning now to FIG. 3, it depicts a flowchart of steps of a signal conversion practice in accordance with the invention. It is assumed that the practices of FIGS. 1 and 2 have been completed, i.e., that the first and second lookup tables have been established and are accessible.

In step S6, INPUT POS PRINTER DRIVE DATA, POS printer drive data is entered in either single line or multiple line structure, as determined by the nature of the input data.

In step S7, SELECT ARTICLE LITERAL IDENTIFICATION DATA FROM INPUT POS PRINTER DRIVE DATA, that portion of the data input in step S6 relating to article literal identification is selected.

In step S8, PERFORM LOOKUP IN LOOKUP IN LOOKUP TABLE ONE FOR SELECTED ARTICLE LITERAL IDENTIFICATION DATA, the first lookup table contents are accessed.

In step S9, ? CORRESPONDENCE IN LOOKUP TABLE ONE, inquiry is made as to whether there is a counterpart article literal identification data in the first lookup table for the selected article literal identification data. Upon negative (N) reply to the inquiry, i.e., the establishment of the first lookup table did not take into account the selected article literal identification, return is to step S6 and a suitable output alarm indication is provided to the system user.

Upon affirmative (Y) reply to the step S9 inquiry, progress is to step S10, ? FLAG DATA DETECTED, inquiry is made as to whether flag data is stored in the first lookup table along with the selected article literal identification data. Upon negative reply to the inquiry, the data is recognized as SLD data and progress is to step S11, OUTPUT LOOKUP TABLE ONE DATA AS SLD OUTPUT DATA.

Upon affirmative reply to the step S10, the selected article literal identification data is recognized as MLD data and progress is to the second lookup table, i.e., to step S12, PERFORM LOOKUP IN LOOKUP IN LOOKUP TABLE TWO FOR SELECTED ARTICLE LITERAL IDENTIFICATION DATA and thence to step S13, ? CORRESPONDENCE IN LOOKUP TABLE TWO.

Upon negative reply to the step S13 inquiry, i.e., the establishment of the second lookup table did not take into account the selected article literal identification, return is to step S6 and a suitable output alarm indication is provided to the system user.

Upon affirmative reply to the step S13 inquiry, progress is to step S14, OUTPUT LOOKUP TABLE TWO DATA AS SLD OUTPUT DATA.

Figure 4:
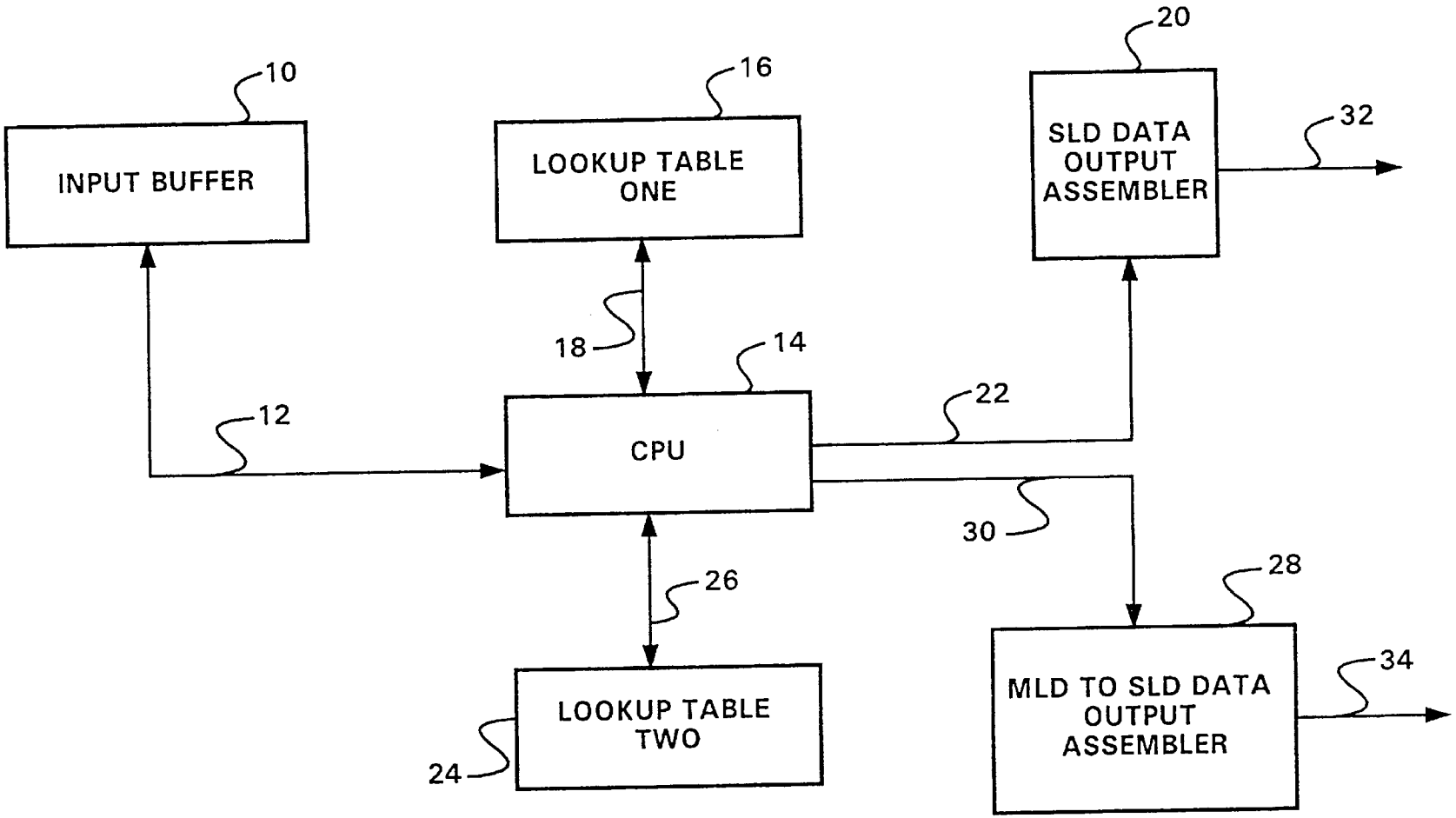
FIG. 4 is a functional block diagram of a system in accordance with the invention.

A system for implementing the practices of FIG. 3 is shown in functional block diagram form in FIG. 4. Referring thereto, INPUT BUFFER 10 receives and holds the data input in step S6 of FIG. 3, i.e., the POS printer drives data in SLD or MLD format. The buffer output signals are applied over lines 12 to CPU 14 (central processing unit—a microprocessor programmed per the FIG. 3 flowchart). Lines 12 are bidirectional and CPU 14 thus communicates readout commands to buffer 10 as desired.

The CPU communicates bidirectionally with LOOKUP TABLE ONE 16 over lines 18. SLD DATA OUTPUT ASSEMBLER 20 receives content of LOOKUP TABLE ONE 16 over lines 22 when CPU 14 concludes that SLD data was input and is to be output as system data.

Upon flag detection by CPU 14 in its examination of data furnished to it by LOOKUP TABLE ONE 16, resort is made to LOOKUP TABLE TWO 24 over bidirectional lines 26. MLD TO SLD DATA OUTPUT ASSEMBLER 28 receives content of LOOKUP TABLE TWO 24 over lines 30 when CPU 14 concludes that MLD data was input and is to be output as system data in SLD format.

System output data made available on output lines 32 and 34 is thus fully in SLD format, readily interpretable by host computer equipment without need for modification of host computer data recognition rules.

Various changes to the particularly disclosed apparatus, systems and practices may evidently be introduced without departing from the invention. Accordingly, it is to be appreciated that the particularly discussed and depicted preferred embodiments and practices of the invention are intended ln an illustrative and not in a limiting sense. The true spirit and scope of the invention are set forth in the ensuing claims.

What is claimed is:

1. A method for processing single line data and multiple line data generated at a POS station for driving a printer thereof into common structure data, (comprising the steps of:

(a) defining a first lookup table having first signal content corresponding to literal article identifications of articles encompassed in said single line data and having second signal content corresponding to literal identifications of articles encompassed in said multiple line data and flag data;

(b) defining a second lookup table having signal content corresponding to article identifications of articles encompassed in said multiple line data cross-correlated with additional multiple line data;

(c) furnishing the single line data and multiple line data generated at said POS station for driving the printer thereof to said first lookup table and determining correspondence of literal identifications in said single line data and said multiple line data with literal identifications stored in said first lookup table and detecting flag data therein;

(d) upon determinations of correspondence of literal identifications without accompanying detection of flag data, furnishing the contents of said first lookup table as single line output data; and (e) upon determinations of correspondence of literal identifications with accompanying detection of flag data, furnishing the contents of said second lookup table as single line output data.

2. A system for processing single line data and multiple line data generated at a POS station for driving a printer thereof into common structure data, comprising:

(a) a first lookup table having first signal content corresponding to literal article identifications of articles encompassed in said single line data and having second signal content corresponding to literal identifications of articles encompassed in said multiple line data and flag data;

(b) a second lookup table having signal content corresponding to article identifications of articles encompassed in said multiple line data cross-correlated with additional multiple line data; and (c) control means for (1) furnishing the single line data and multiple line data generated at said POS station for driving the printer thereof to said first lookup table and determining correspondence of literal identifications in said single line data and said multiple line data with literal identifications stored in said first lookup table and detecting flag data therein;

(2) upon determinations of correspondence of literal identifications without accompanying detection of flag data, furnishing the contents of said first lookup table as single line output data, and (3) upon determinations of correspondence of literal identifications with accompanying detection of flag data, furnishing the contents of said second lookup table as single line output data.

3. A method of operating a point of sale station, the method comprising the steps of:

(a) storing a first lookup table, said table including a first plurality of article identification data entries and a second plurality of article identification data entries, each of said first plurality of data entries corresponding to articles for which single line printer drive signals are generated and not including flag data, each of said second plurality of data entries corresponding to articles for which multiple line printer drive signals are generated and including flag data;

(b) storing a second lookup table including a third plurality of data entries, each corresponding to a respective one of said second plurality of data entries of said first lookup table;

(c) generating printer drive data;

(d) determining whether a portion of the printer drive data corresponds to one of the data entries of the first lookup table;

(e) if a positive determination is made at step (d), determining whether flag data is included in the corresponding data entry of the first lookup table;

(f) if a negative determination is made at step (e), outputting data included in the corresponding data entry of the first lookup table in a single line data format;

(g) if a positive determination is made at step (e), determining whether the portion of the printer drive data corresponds to one of the data entries of the second lookup table; and (h) if a positive determination is; made at step (g), outputting data included in the corresponding data entry of the second lookup table in a single line format;

whereby the point of sale station operates to convert multiple line printer drive signals to single line output data.

* * * * *

UNITED STATES PATENT AND TRADEMARK OFFICE

CERTIFICATE OF CORRECTION

PATENT NO. : 5,924,806

DATED : July 20, 1999

INVENTOR(S) : Elwyn Thomas Ainsworth

It is certified that error appears in the above-identified patent and that said Letters Patent is hereby corrected as shown below:

Col. 3, line 57, delete "drives" and insert --drive--.

Col. 4, line 16, delete "In" and insert --in--.

Col. 4, line 22, delete "("

Signed and Sealed this

Twenty-fifth Day of July, 2000

*Attest:*

*Attesting Officer*

Q. TODD DICKINSON

*Director of Patents and Trademarks*